US006134935A

United States Patent [19]

Minnerop

[11] Patent Number: 6,134,935

[45] Date of Patent: Oct. 24, 2000

[54] APPARATUS AND METHOD FOR DETERMINING AND SETTING A STAND CENTER AND ADJUSTING POSITIONS OF A ROLL STAND

[75] Inventor: Michael Minnerop, Ratingen, Germany

[73] Assignee: SMS Schloemann-Siemag Aktiengesellschaft, Düsseldorf, Germany

[21] Appl. No.: 09/348,744

[22] Filed: Jul. 6, 1999

[30] Foreign Application Priority Data

Jul. 15, 1998 [DE] Germany ..... 198 31 663

[51] Int. Cl.[7] ..... B21B 31/07; B21B 13/10

[52] U.S. Cl. ..... 72/237; 72/225

[58] Field of Search ..... 72/245, 249, 237, 72/225, 224, 226

[56] References Cited

U.S. PATENT DOCUMENTS

| | | | |
|---|---|---|---|
| 3,557,595 | 1/1971 | Illert | 72/237 |
| 3,948,072 | 4/1976 | Aramaki | 72/245 |
| 5,765,424 | 6/1998 | Mantovan | 72/245 |

*Primary Examiner*—Rodney A. Butler
*Attorney, Agent, or Firm*—Friedrich Kueffner

[57] ABSTRACT

An apparatus and a method for determining and setting the center of a roll stand and adjusting positions of a roll stand, wherein the bearing chocks of the horizontal rolls have processed planar support surfaces located opposite each other and preferably parallelepiped-shaped spacer pieces with defined dimensions are placed on these support surfaces. Defined pressures are applied to the spacer pieces by adjusting the rolls, wherein the resulting adjustment positions are determined and used as actual values for the position determining system which controls the roll stand during the rolling operation.

4 Claims, 1 Drawing Sheet

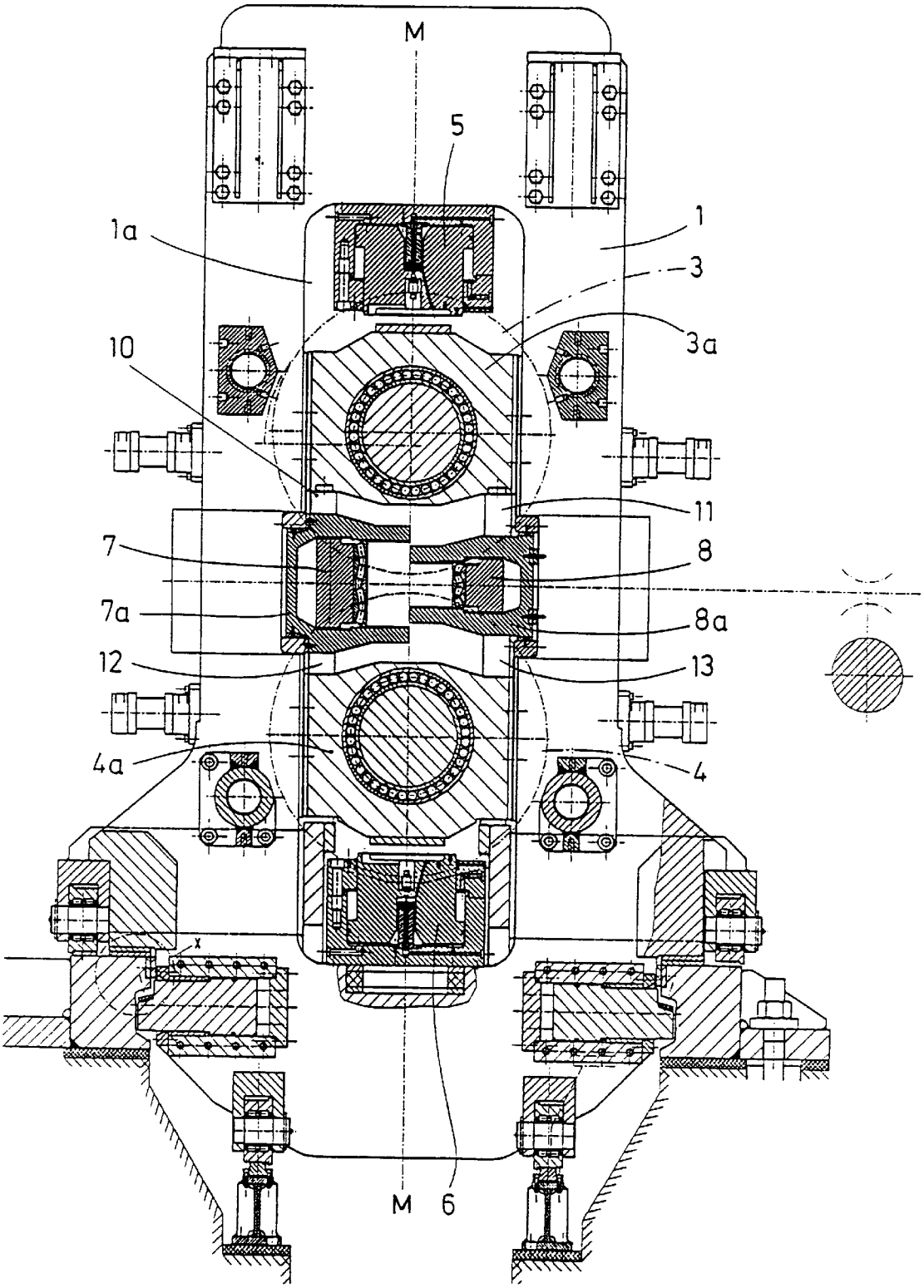
M
5
1a
1
3
3a
10
11
7
8
7a
8a
12
13
4a
4
M
6

APPARATUS AND METHOD FOR DETERMINING AND SETTING A STAND CENTER AND ADJUSTING POSITIONS OF A ROLL STAND

BACKGROUND OF THE INVENTION

1. Field of the Invention

The present invention relates to an apparatus and a method for determining and setting the center of a roll stand and adjusting positions of a roll stand.

2. Description of the Related Art

Determinations and settings of this type have in the past been carried out by means of measuring devices, guiding units and gap measuring units, wherein the measurements referred to distances between reference edges, for example, bearing chocks and housing edges. However, due to the play between the structural elements which cannot be controlled, due to inclined positions of the bearing chocks in the housing window, due to the failure to achieve a complete contact between the elements of the adjusting device as a result of grease and dirt, due to the occasional tilting movements of the adjusting device, and due to reference surfaces which are not processed or inaccurately processed, the results of this method are frequently inaccurate and often require a lot of time.

SUMMARY OF THE INVENTION

Therefore, it is the primary object of the present invention to provide an apparatus and a method which makes it possible to carry out the determination and setting of precise values while requiring substantially less time.

In accordance with the invention, the bearing chocks of the horizontal rolls have processed planar support surfaces located opposite each other and preferably parallelepiped-shaped spacer pieces with defined dimensions are placed on these support surfaces. Defined pressures are applied to the spacer pieces by adjusting the rolls, wherein the resulting adjustment positions are determined and used as actual values for the position determining system which controls the roll stand during the rolling operation.

In accordance with a further development of the invention, the spacer pieces are placed in pairs on both sides of and with the same distance from the common vertical center axis plane of the horizontal roll pair between the upper and lower side surfaces of the bearing chocks of the lower and the upper horizontal roll, respectively, and the lower and upper side surfaces of the bearing chocks of the two vertical rolls, respectively.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic vertical sectional view of a universal roll stand taken transversely of the rolling direction.

DESCRIPTION OF THE PREFERRED EMBODIMENTS

As illustrated in the drawing, the bearing chocks 3*a* of the upper horizontal roll, shown in dash-dot lines, and the bearing chocks 4*a* of the lower horizontal roll 4, also shown in dash-dot lines, are guided in the housing window 1*a* of the roll stand housing 1. An adjusting piston/cylinder unit 5 acts on the bearing chocks 3*a* of the upper horizontal roll 3 and an adjusting piston/cylinder unit 6 acts on the bearing chocks 4*a* of the lower horizontal roll 4. Electromechanical units can also be used instead of the adjusting piston/cylinder units.

The vertical rolls 7 and 8, shown with different sizes in the drawing, are supported in the horizontally guided bearing chocks 7*a* and 8*a*, respectively. Spacer pieces 10 and 11 are placed between the lower side surface of the bearing chock 3*a* of the upper horizontal roll 3 and the upper side surface of the bearing chocks 7*a* and 8*a* of the vertical rolls 7 and 8, respectively, wherein the spacer pieces 10 and 11 are arranged on both sides of the vertical center axis plane M of the two horizontal rolls 3 and 4. In the same manner, spacer pieces 12 and 13 are placed between the upper side surfaces of the bearing chock 4*a* of the horizontal roll 4 and the lower side surfaces of the bearing chocks 7*a* and 8*a* of the vertical rolls 7 and 8, respectively.

The spacer pieces 10, 11 and 12, 13 are then moved by the pressure of, for example, 500 kN applied by the adjusting piston/cylinder units 5 and 6 on the upper and lower bearing chocks 3*a* and 4*a* toward the upper and lower side surfaces of the two bearing chocks 10*a* and 11*a* of the vertical rolls 10 and 11. When these predetermined calibrating pressures are reached, the adjustment positions of the two bearing chocks 3*a* and 4*a* of the upper horizontal roll 3 and of the lower horizontal roll 4 are picked up as actual values by the electrical position determination system and are used for determining the stand center and the adjusting ranges.

In accordance with this method of operation, any existing plays between the structural elements caused, for example, by grease, dirt, air, and any inclined positions of the structural elements are eliminated from the beginning.

While specific embodiments of the invention have been shown and described in detail to illustrate the inventive principles, it will be understood that the invention may be embodied otherwise without departing from such principles.

I claim:

1. An apparatus for determining and setting a stand center and adjustment positions in a roll stand, wherein the roll stand includes bearing chocks for horizontal rolls, the apparatus comprising spacer pieces having defined dimensions placed between processed planar support surfaces of the bearing chocks of the horizontal rolls which are located opposite each other, and means for adjusting the rolls with a defined pressure and for setting resulting adjustment positions as actual values for a position determining system for controlling the roll stand during a rolling operation, wherein the roll stand further includes two vertical rolls, and wherein the spacer pieces are placed on both sides with an equal distance from a common vertical center axis plane of the horizontal rolls between an upper side surface and a lower side surface of the bearing chocks of the lower and upper horizontal rolls and between a lower side surface and an upper side surface of both vertical rolls.

2. The apparatus according to claim 1, wherein the spacer pieces are parallelepiped-shaped.

3. A method of determining and setting adjustment positions in a roll stand, wherein the roll stand includes bearing chocks for horizontal rolls, the apparatus including spacer pieces having defined dimensions placeable between processed planar support surfaces of the bearing chocks of the horizontal rolls which are located opposite each other, the method comprising placing the spacer pieces between the support surfaces of the bearing chocks and applying a defined pressure on the spacer pieces by means of a positioning device of the rolls, setting resulting adjustment positions of the bearing chocks, and utilizing the resulting adjustment positions, after removing the spacer pieces, as actual values for positioning the rolls during rolling.

4. The method according to claim 3, wherein the roll stand includes two vertical rolls, further comprising placing the spacer pieces on both sides with an equal distance from a common vertical center axis plane of the horizontal rolls between an upper side surface and a lower side surface of the bearing chocks of the lower and upper horizontal rolls and between a lower side surface and an upper side surface of both vertical rolls.

* * * * *